US006067964A

United States Patent [19]

Ruoff et al.

[11] Patent Number: 6,067,964

[45] Date of Patent: May 30, 2000

[54] FUEL INJECTION SYSTEM FOR AN INTERNAL COMBUSTION ENGINE

[75] Inventors: Manfred Ruoff, Moeglingen; Horst Harndorf, Schwieberdingen, both of Germany

[73] Assignee: Robert Bosch GmbH, Stuttgart, Germany

[21] Appl. No.: 09/331,476

[22] PCT Filed: Sep. 18, 1998

[86] PCT No.: PCT/DE98/02771

§ 371 Date: Jul. 23, 1999

§ 102(e) Date: Jul. 23, 1999

[87] PCT Pub. No.: WO99/20893

PCT Pub. Date: Apr. 29, 1999

[30] Foreign Application Priority Data

Oct. 22, 1997 [DE] Germany ..... 197 46 492

[51] Int. Cl.[7] ..... F02M 32/04

[52] U.S. Cl. ..... 123/467; 123/585

[58] Field of Search ..... 123/575, 576, 123/577, 578, 467, 458, 506, 447, 299, 300

[56] References Cited

U.S. PATENT DOCUMENTS

| | | | |
|---|---|---|---|
| 4,520,774 | 6/1985 | Sitter | 123/575 |
| 4,524,033 | 6/1985 | Elledge | 123/575 |
| 4,590,904 | 5/1986 | Wannenwetsch | 123/575 |
| 4,612,905 | 9/1986 | Dietrich | 123/575 |
| 4,693,227 | 9/1987 | Satou | 123/575 |
| 4,705,010 | 11/1987 | Baranescu | 123/575 |
| 5,174,247 | 12/1992 | Tosa | 123/575 |
| 5,732,679 | 3/1998 | Takahashi | 123/467 |
| 5,862,793 | 1/1999 | Jay | 123/467 |
| 5,979,410 | 11/1999 | Grieshaber | 123/467 |

*Primary Examiner*—Carl S. Miller

*Attorney, Agent, or Firm*—Ronald E. Greigg; Edwin E. Greigg

[57] ABSTRACT

A fuel injection system having a common rail pressure reservoir filled with high-pressure fuel and having a dual-fuel injector for a bi-fluid injection of fuel and an additive fluid into an internal combustion engine. The system includes a first 2/2-way valve in the injection line between the common rail pressure reservoir and a pressure chamber encompassing the injector needle of the dual-fuel injector as well as a second 2/2-way valve, whose inlet is connected via a supply line to the injection line at a point between the first 2/2-way valve and the pressure chamber, and whose outlet is connected to the low-pressure fuel side by way of an outlet line. As a result, the otherwise conventional 3/2-way solenoid control valves, which are significantly more complex technically, can be replaced by more reasonably priced 2/2-way valves. At the same time, this raises the possibility of shifting the quantity metering for additive fluid to a single metering valve that serves an entire group of injectors.

25 Claims, 4 Drawing Sheets

FUEL INJECTION SYSTEM FOR AN INTERNAL COMBUSTION ENGINE

PRIOR ART

The invention is based on a fuel injection system for an internal combustion engine.

Fuel injection systems of this type are known, for example, from DE 43 37 048 C2. On the one hand, a dual-fuel injector is provided, which is used for the layered injection of fuel and an additive fluid, for example diesel fuel and water, in order to reduce the pollutant emissions of the engine and if need be, to improve the efficiency. On the other hand, in the known injection system, the so-called common rail technique is also used, in which all of the fuel injectors serving the engine are supplied with high-pressure fuel from a common rail pressure reservoir.

In the known fuel injection system, it is disadvantageous that for each individual injector, a complicated and relatively expensive 3/2-way valve is required for quantity metering of the additive fluid and another 3/2-way valve is required for controlling the diesel injection quantity. In order to store up the additive fluid, the fuel supply from the common rail pressure reservoir to the injection valve is interrupted by the first 3/2-way valve and at the same time, a pressure chamber that encompasses the fuel injector and in which high-pressure fuel is stored, is relieved toward the low-pressure fuel side through a corresponding position of the first 3/2-way valve. Due to the pressure difference produced in the pressure chamber, additive fluid is fed into the pressure chamber by way of a corresponding line, which displaces the corresponding volume of fuel. Then, the first 3/2-way valve is brought back into a position that produces a connection between the common rail pressure reservoir and the pressure chamber in the injection valve. The other 3/2-way solenoid valve is provided for the precise quantity metering of the fuel quantity to be injected, which should follow the stored up additive fluid in the injection blast brought about by the next valve opening, and this other 3/2-way solenoid valve connects the rear of the injector needle, which is held in the closed position by a spring, alternatively either to the common rail pressure reservoir or to the low-pressure fuel side and as a result, chronologically controls the stroke of the valve needle, the opening and closing of the valve, and therefore the desired injection quantity.

In principle, the known fuel injection system requires both of the precisely operating and therefore complicated 3/2-way control solenoid valves for each individual injector in order to be able to precisely meter both the desired fuel quantity and the required quantity of additive fluid.

ADVANTAGES OF THE INVENTION

In order to simplify the design and thereby reduce the cost of its manufacture, the fuel injection system will be set forth hereinafter. As a result, the two complex and expensive 3/2-way solenoid control valves can be replaced with simpler and less expensive 2/2-way valves, which simultaneously raises the possibility of shifting the quantity metering for the additive fluid to a single, precisely operating metering valve that can serve an entire group of injectors. Whereas the second 2/2-way valve only controls the opening and closing time for the storing up of additive fluid, the quantity metering for the fuel quantity to be injected is produced by means of a corresponding time control of the first 2/2-way valve in the injection line between the common rail pressure reservoir and the pressure chamber.

In order to assure uniform pressure conditions in the line system and in particular, in order to prevent a degassing of the additive fluid—as a rule water—when the boiling point is exceeded, even at high temperatures, the use of a check valve is suggested between the second 2/2-way valve and the low-pressure fuel side.

It is also advantageous if, on the blunt end of its injector tappet, the injector needle supports a small piston in the radial extension, which piston protrudes into a chamber that is acted on with high pressure from the common rail pressure reservoir and is in turn sealed off in a pressure-tight manner from the chamber encompassing the injector needle. Through the impingement of the common rail pressure on the uniform piston surface, the control movements of the injector needle in the injection process are independent of the absolute pressure conditions in the common rail pressure reservoir because in order to move the injector tappet, the same resistance, namely the spring force of the valve spring, must always be overcome so that the movement forces remain constant. As a result, constant switching times are produced that are favorable for technical regulating reasons and that are determined by the respective movement time of the injector tappet.

One embodiment of the fuel injection system according to the invention is particularly preferable in which in order to deliver the additive fluid, a membrane is used whose one side is acted on by the high pressure prevailing in the common rail pressure reservoir and whose other side, due to the pressure impulses in the common rail pressure reservoir, produces a delivery of additive fluid into the additive fluid line leading to the dual-fuel injector either directly or via a lever mechanism.

The indirect delivery of additive fluid can take place, for example, by way of a pump piston which is connected to the membrane by means of a lever mechanism and which, when there are pressure changes in the common rail pressure reservoir that lead to a membrane movement, delivers a corresponding quantity of additive fluid. In order to compensate for a membrane path drift, for example when there are various common rail basis pressures, as well as in order to precisely regulate the quantity metering of the additive fluid delivered, the lever ratio and therefore the stroke volume of the pump piston can be influenced by means of an adjusting mechanism, which can be driven, for example, by means of an electric motor. Due to the proportionality of the withdrawn fuel quantity to the delivered additive fluid quantity, however, adjustments may hardly be necessary so that the device according to the invention has a high degree of operational stability.

In order to damp smaller pressure fluctuations with higher frequencies, in an improvement, the delivery system for the additive fluid can be embodied as a type of "hydraulic low-pass filter" in which a solid dividing wall (also referred to as a mass wall) clamps the membrane at one end of the common rail pressure reservoir, wherein a diaphragm bore is provided in the mass wall and permits a damped pressure compensation between the common rail pressure reservoir and the chamber between the mass wall and the membrane. In the electrical analogy of a low-pass filter, the mass wall would in this connection correspond to the inductance, the diaphragm bore would correspond to the ohmic resistance, and the membrane would correspond to a capacitor. As a result, only larger low frequency pressure fluctuations due to large volume movements of the fuel affect the membrane movement and therefore the delivery of additive fluid.

An embodiment of the fuel injection system according to the invention is also very particularly preferred in which another common rail pressure reservoir is provided to contain pressurized additive fluid, which is connected by way of a 2/2-way valve to additive fluid line leading to the dual-fuel injector and has similar advantages to the intrinsically known common rail pressure reservoir for fuel. In particular, with the use of an additional common rail pressure reservoir of this kind, the above-described delivery mechanism for the additive fluid can be considerably simplified by virtue of the fact that the membrane produces the delivery of additive fluid via a check valve directly and without the interposition of a lever mechanism, which drives a pump piston, through transmission of corresponding pressure impacts to the other common rail pressure reservoir.

A particular advantage of using another common rail pressure reservoir for additive fluid is comprised in that the 2/2-way valve in the additive fluid line can supply an entire group of injectors, wherein all that has to be assured is that no time overlaps of the metering events for the individual injectors occur.

Other advantages and advantageous embodiments of the subject of the invention can be inferred from the description, the drawings, and the claims.

BRIEF DESCRIPTION OF THE DRAWINGS

Four exemplary embodiments of the fuel injection system according to the invention for internal combustion engines are shown in the drawings and will be explained in the description that follows.

DESCRIPTION OF THE EXEMPLARY EMBODIMENTS

Figure 1:
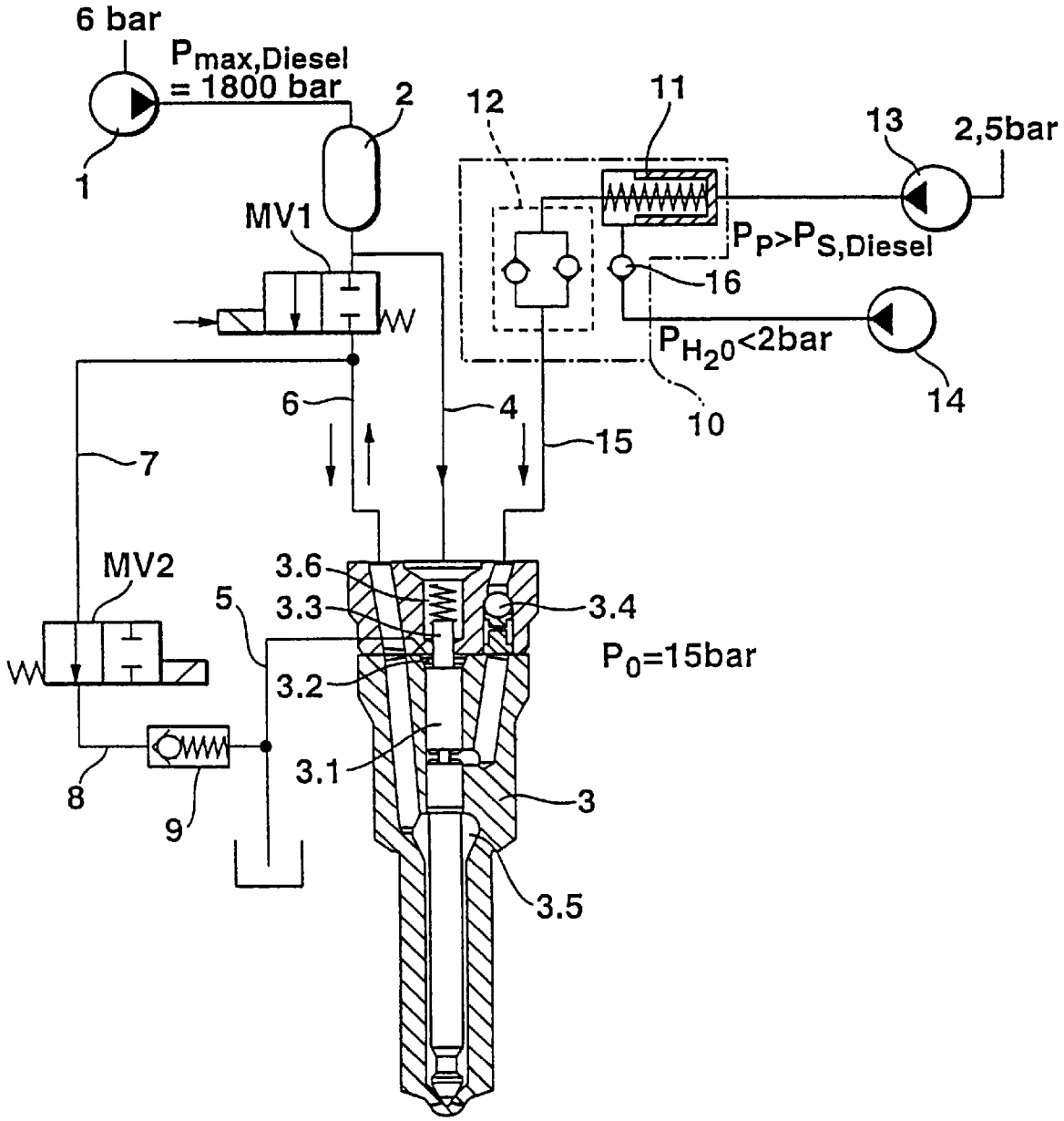
FIG. 1 depicts a schematic wiring of a first exemplary embodiment of the fuel injection system according to the invention, with two 2/2-way valves for quantity control of the delivery or injection of fuel and additive fluid by means of a dual-fuel injector that is schematically depicted in a longitudinal section, wherein the additive fluid line to the dual-fuel injector is charged by a separating piston system with a constant pressure valve device.

In the first exemplary embodiment of the fuel injection system according to the invention for an internal combustion engine, which is shown in FIG. 1 and is for bi-fluid injection of fuel (as a rule diesel fuel) and an additive fluid (as a rule water), a high-pressure pump 1 supplies a common rail pressure reservoir 2 with fuel at a pressure level of approximately 1800 bar. Between the common rail pressure reservoir 2 and a pressure chamber 3.5, which encompasses the injector needle 3.1 of a dual-fuel injector 3 and is to be supplied with fuel from this common rail pressure reservoir by way of an injection line 6, a quantity-metering component must now be disposed since the previously conventional, classic injection pump has in fact been replaced by the combination of the common rail pressure reservoir 2 and the simpler high-pressure pump 1 and the rail pressure is continuously available at a certain level. In the device according to the invention, this task is handled by a first 2/2-way valve MV1. This should be designed as a rapid solenoid valve with a favorable reproducibility and a more or less fluid transition between the two extreme positions since an injection quantity progression that can be chronologically controlled may possibly be required. The precise quantity metering is made possible by way of the known (measured or controlled) pressure difference between the common rail pressure reservoir 2 and the combustion chamber of the engine to be fed by the dual-fuel injector 3, by means of a precise time window whose size depends on other influence factors, by way of an electrical control that is not shown in the drawing.

The design and function of the dual-fuel injector 3 is known from the prior art with the exception of small details. With the system according to the invention, however, on the blunt end of the injector needle (injector tappet) 3.1 remote from the tip of the injector needle, a small piston 3.3 is provided, which protrudes with its end remote from the injector needle 3.1 into a chamber 3.6 which is directly connected to the common rail pressure reservoir 2 by way of a line 4 and is acted on with the high pressure prevailing there. This results in the fact that in order to move the injector tappet 3.1, essentially the same resistance force must always be overcome since now, as a result of the constant piston area ratios and the exclusion of influences of the absolute pressure in the common rail pressure reservoir 2, only a constant spring pressure has to be overcome by a pressure impulse from the (variable) rail pressure. As a result, almost constant switching times (movement time of the injector tappet) are produced, which are welcome for technical regulating reasons. In order to ventilate the chamber 3.2, which contains the blunt axial end of the injector needle 3.1 and is sealed off from the chamber 3.6 in a high pressure manner, a ventilation line 5 is provided, which leads to the low-pressure fuel side.

For the introduction of additive fluid, now, as is intrinsically known in principle from the prior art, a path out of the dual-fuel injector 3 must be cleared for the fuel to be displaced by the additive fluid. This takes place by means of a suitable connection of a second 2/2-way valve MV2, whose inlet is connected to the injection line 6 by way of a supply line 7 and whose outlet is connected to the low-pressure fuel side by way of an outlet line 8. If additive fluid is to be metered, the first 2/2-way valve MV1 is closed and the second 2/2-way valve is switched open. As a result, high-pressure fuel escapes from the pressure chamber 3.5 by way of the injection line 6, the supply line 7, the outlet line 8, and a check valve 9 to the low-pressure fuel side, as a rule the fuel tank. As a result, additive fluid can flow in a replenishing fashion from an additive fluid line 15 leading to the dual-fuel injector 3, by way of a check valve 3.4, and into the pressure chamber 3.5 (at $p_0$=15 bar) . However, the fluid-guiding bores of the dual-fuel injector 3 and the line lengths must be dimensioned and the lines must be attached so that no additive fluid can get into the fuel tank.

Before the actual injection event of the additive fluid, the correct quantity of it must be metered and supplied at a low system pressure into the dual-fuel injector 3. This is achieved by means of a so-called M-pump 13, which delivers an operating fluid at a pre-pressure level of approximately 2.5 bar into a separating piston adapter 10 with a separating piston 11 and a constant pressure valve 12. The separating piston adapter 10 separates the operating fluid (as a rule diesel fuel) of the M-pump 13 from the additive fluid to be introduced (as a rule water). A fill pump 14 charges the water side of a traveling cylinder in the separating piston 11 with additive fluid at a low pressure (p<2 bar) by way of a check valve 16. At the correct time before the actual injection, i.e. between the injection cycles, a desired quantity of operating fluid is delivered to the separating piston 11 with a higher pressure than the one at which the check valve 3.4 of the dual-fuel injector 3 is set. As a result, the quantity of additive fluid, which corresponds to the quantity of operating fluid of the M-pump 13 on the other side of the separating piston 11, is sent to the additive fluid line 15 by way of the constant pressure valve 12. The constant pressure valve 12 is used for pressure relief or for correctly delivering pre-pressure to the additive fluid line 15 between the separating piston adapter 11 and the dual-fuel injector 3.

The second 2/2-way valve MV2 can incidentally be a relatively simple valve that is more reasonably priced than the first 2/2-way valve MV1 since the exactness of the latter for the function of displacing fuel from the pressure chamber 3.5 is not absolutely required for the purpose of storing up additive fluid and otherwise, only a definite yes/no behavior of the valve MV2 is required.

Figure 2:
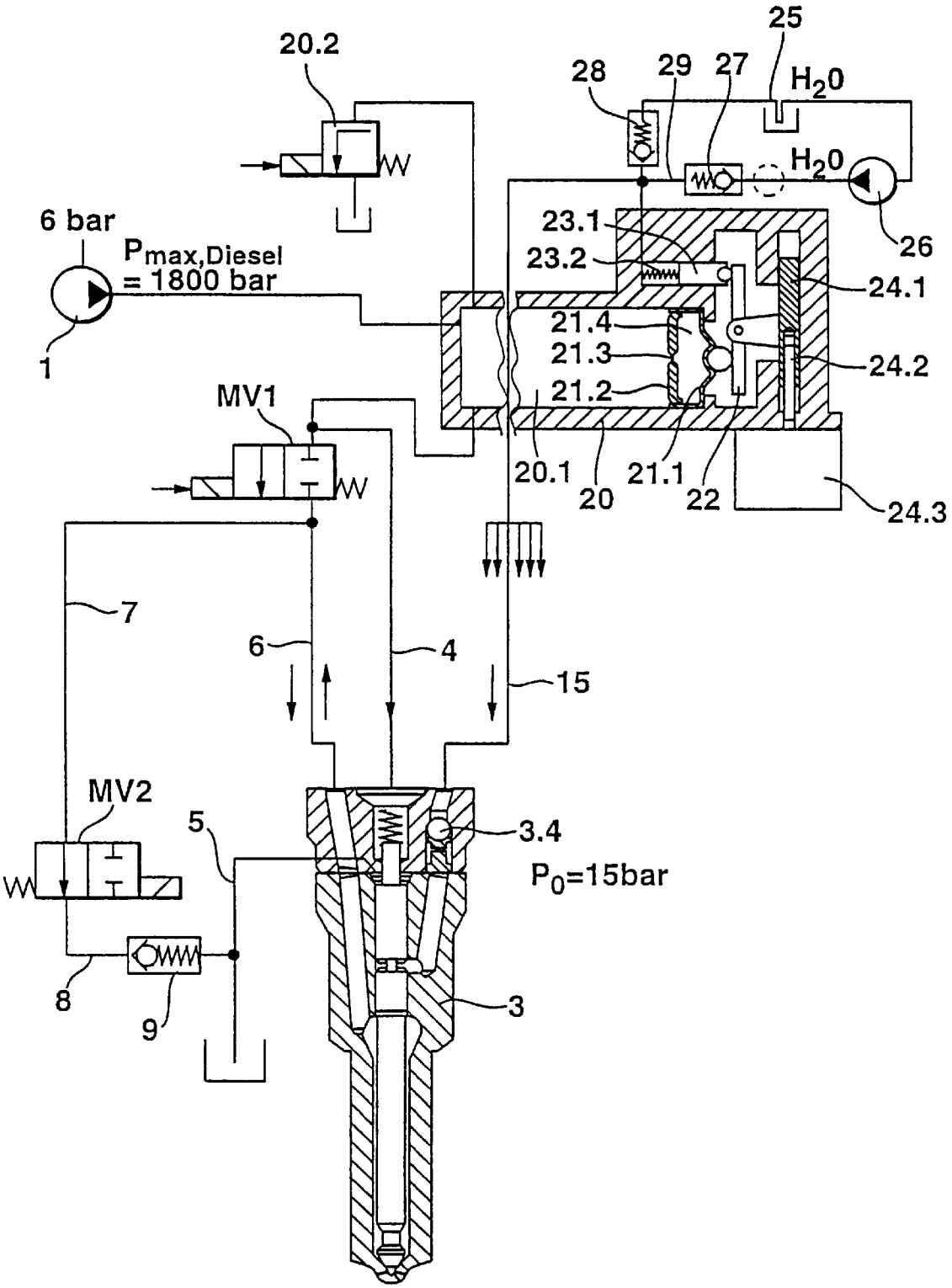
FIG. 2 shows a second exemplary embodiment with a membrane-operated additive fluid pump, wherein the membrane is controlled by the pressure in the common rail pressure chamber and drives a delivery pump piston by way of a lever mechanism.

The second exemplary embodiment of the fuel injection system according to the invention shown in FIG. 2 differs from the one shown in FIG. 1 by means of a modification of the part of the assembly that is responsible for the delivery of the additive fluid. In order to replace the expensive M-pump 13 from FIG. 1 with more reasonably priced subassemblies, now a pump for the additive fluid is coupled to the common rail pressure reservoir 20. To that end, a membrane 21.1 is connected by means of a mass wall 21.2 to an end of the common rail pressure reservoir 20, wherein due to a slightly conical outer contour, the mass wall 21.2 clamps the membrane 21.1 in a pressure-tight manner into a pressure-tight chamber 20.1 of the common rail pressure reservoir 20. A diaphragm bore 21.3 is provided in the mass wall 21.2, and fuel from the high-pressure chamber 20.1 can travel via this bore into or out of a chamber 21.4 that is enclosed by the membrane 21.1 and the mass wall 21.2, depending on the pressure difference direction.

A lever mechanism 22 is connected on one end to the side of the membrane 21.1 remote from the chamber 21.4 and is connected on the other end to a pump piston 23.1. In addition, the lever mechanism 22 is supported so that it can rotate on a slider 24.1 that is guided so that it can move longitudinally. Pressure fluctuations in the high-pressure chamber 20.1 due to abrupt withdrawal of the injection quantity of fuel produce a movement of the membrane 21.1. The membrane path produces a back and forth motion of the lever mechanism 22, which in turn results in a corresponding stroke of the pump piston 23.1. The pump piston 23.1 is correspondingly pre-stressed by way of a compression spring 23.2 so that no "slack" can arise in any movement phase.

During the intake phase, the pump piston 23.1, supported by a pre-feed pump 20, aspirates a corresponding quantity of additive fluid from a tank 25 by way of a line 29 with a check valve 27. Upon ejection, the water quantity is displaced into the dual-fuel injector 3 by way of the additive fluid line 15 and the check valve 3.4 if the second 2/2-way valve MV2 has been opened in order to direct the water quantity as a result of a command from the motor management, not shown in the drawing.

In order to prevent stress fractures, for example as a result of a malfunction of the 2/2-way valve MV2, an overpressure check valve 28 is disposed in an overpressure line that branches from the additive fluid line 15, feeds directly into the reservoir 25, and, when a corresponding threshold pressure is exceeded, opens and produces a connection between the additive fluid line 15 and the reservoir 25.

In order to be able to correctly meter the desired quantity of additive fluid, the slider 24.1 is moved up or down in accordance with a rotation command of the motor management by an electric motor 24.3, which supports a spindle 24.2 that is screwed into the slider 24.1. As a result, the lever ratio of the lever mechanism 22 is adjusted so that various stroke volumes of the pump piston 23.1 can be set. In this manner, either the pump device can meter different quantities of additive fluid from one injection event to another in the same injector 3 or other injectors connected to the additive fluid line 15 (indicated in the drawings by a series of parallel arrows) can be individually charged with the quantity of additive fluid that is respectively correct for them.

The fuel pressure in the high-pressure chamber 20.1, which can be varied with a pressure control valve 20.2, also exerts influence on the movement control of the slider 24.1 by way of a membrane drift. In order to be able to execute somewhat precise quantity measurements of the additive fluid to be injected, the pressure fluctuations in the high-pressure chamber 20.1 should be measured and calculated with the membrane identity by means of the motor management. Based on this, the corresponding rotation command can then be sent to the electric motor 24.3, wherein a position recognition of the spindle 24.2 is also helpful.

Alternatively, the current stroke of the pump piston 23.1 can also be measured and then compared to and calculated with other important currently available data as well as the current planned change in order to be able to obtain an adaptation to new conditions as rapidly as possible (for example a change of the gas pedal position by the driver of a motor vehicle).

Nervous reactions of the membrane 21.1, which are caused in the high-pressure chamber 20.1 by pressure peaks or other smaller pressure fluctuations with higher frequencies and are detrimental to a precise metering of the required additive fluid, are damped by a suitable sizing and balancing of the mass wall 21.2 with the diaphragm bore 21.3 and the spring behavior of the membrane 21.1. In the dynamic interaction of the three elements mentioned, namely a behavior is set which is equivalent to a hydraulic low-pass filter, wherein in the electrical analogy, the mass wall 21.2 corresponds to an inductance, the diaphragm bore 21.3 corresponds to an ohmic resistance, and the membrane 21.1 corresponds to a capacitor. In this manner, only larger low frequency pressure fluctuations, which are caused by larger volume movements in the high-pressure chamber 20.1, have an effect on the membrane movements. A hydraulic low-pass filter of this kind also has an advantageous effect on the pressure conditions in the high-pressure chamber 21.1 since it also produces a damping of pressure fluctuations.

Figure 3:
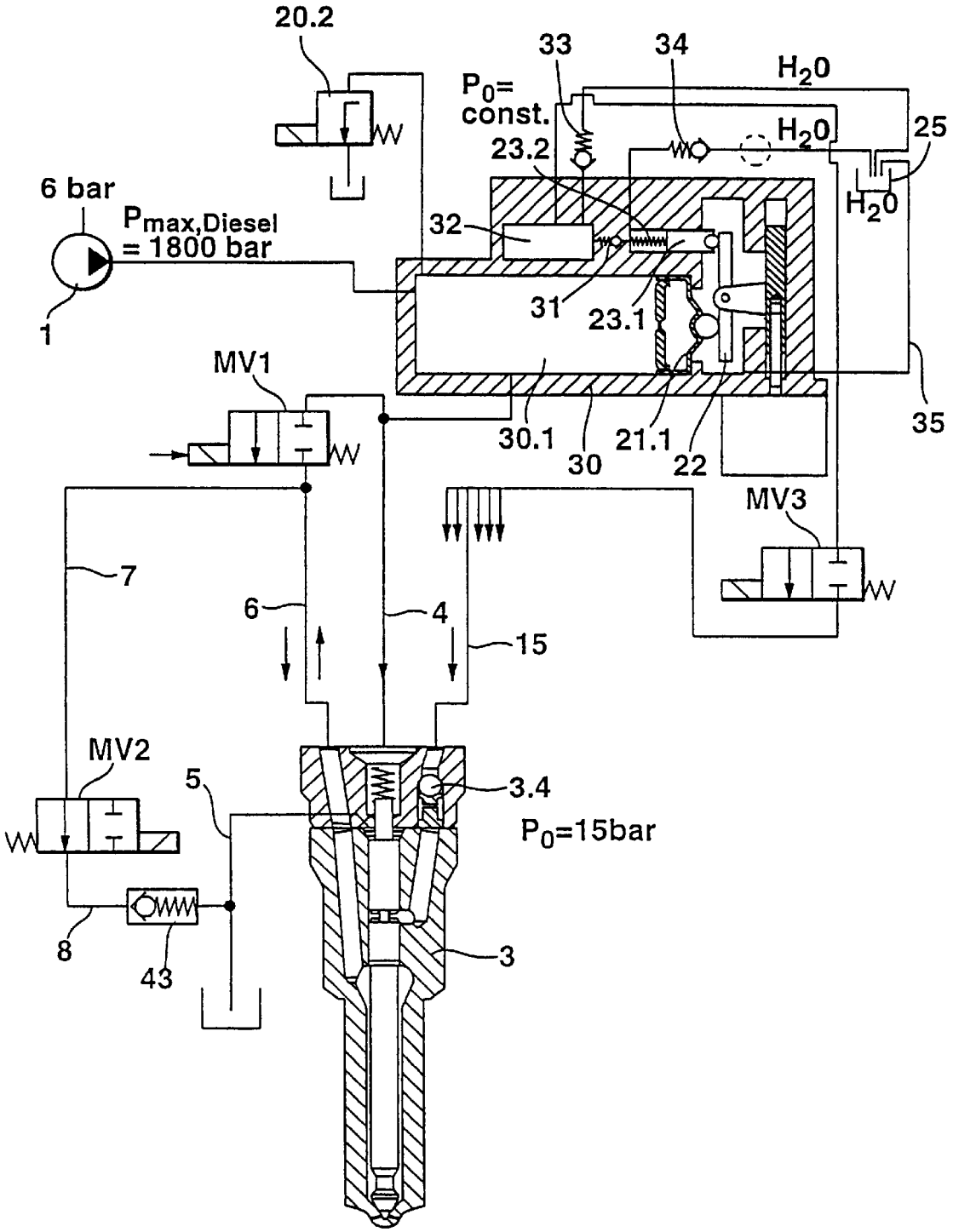
FIG. 3 shows a third exemplary embodiment analogous to FIG. 2, but with another common rail pressure reservoir for additive fluid.

The embodiment shown in FIG. 3 differs from the one according to FIG. 2 essentially by virtue of the fact that in order to supply water to the dual-fuel injector 3, now another common rail pressure reservoir 32 is provided for containing pressurized additive fluid, which is connected by way of another 2/2-way valve MV3 to the additive fluid line 15 leading to the dual-fuel injector 3 and is connected to the delivery side of the membrane-operated pump piston 23.1 by way of a check valve 31.

A compact and space-saving overall device is produced when, as shown in FIG. 3, the other common rail pressure reservoir 32 for the additive fluid is connected to and of one piece with the common rail pressure reservoir 30, which encompasses the high-pressure chamber 30.1 for the fuel.

The function of the quantity metering of additive fluid in this embodiment is also facilitated, among other things, by virtue of the fact that it is separated from the function of delivering additive fluid. In this manner, the quantity metering can also take place in a more precise manner.

In order to save costs (higher numbers of pieces), the additional 2/2-way valve MV3 can be embodied as structurally identical to the first 2/2-way valve MV1, wherein the 2/2-way valve MV3, however, must be suitable for operation with the additive fluid. In addition, the additional 2/2-way valve MV3 can supply an entire group of dual-fuel injectors 3, provided that there are no time overlaps of the metering events for the different injectors. The injector into which the respectively metered quantity of additive fluid should be sent is in turn determined by a simply designed second 2/2-way valve MV2, which, however, must be present for each dual-fuel injector of the group.

In order to keep the pressure difference between the additional common rail pressure reservoir 32 with the additive fluid and the rest of the hydraulic resistance chain, which pressure difference can be exploited for technical control purposes, the additional common rail pressure reservoir 32 is connected to the reservoir 25 for additive fluid by way of a pressure maintenance valve 33 ($p_0$=const). At the end of the hydraulic resistance chain, another pressure maintenance valve 43 is provided in the outlet line 8, which connects the second 2/2-way valve MV2 to the low-pressure fuel side.

In order to drain a possible leakage of additive fluid from the chamber that encloses the lever mechanism 22, a leakage line 35 is attached that feeds into the reservoir 25.

The delivery of additive fluid from the additive container 25 takes place by way of a check valve 34. In order to support the fluid delivery, an additional pump can be provided, which is not shown in the drawing.

Figure 4:
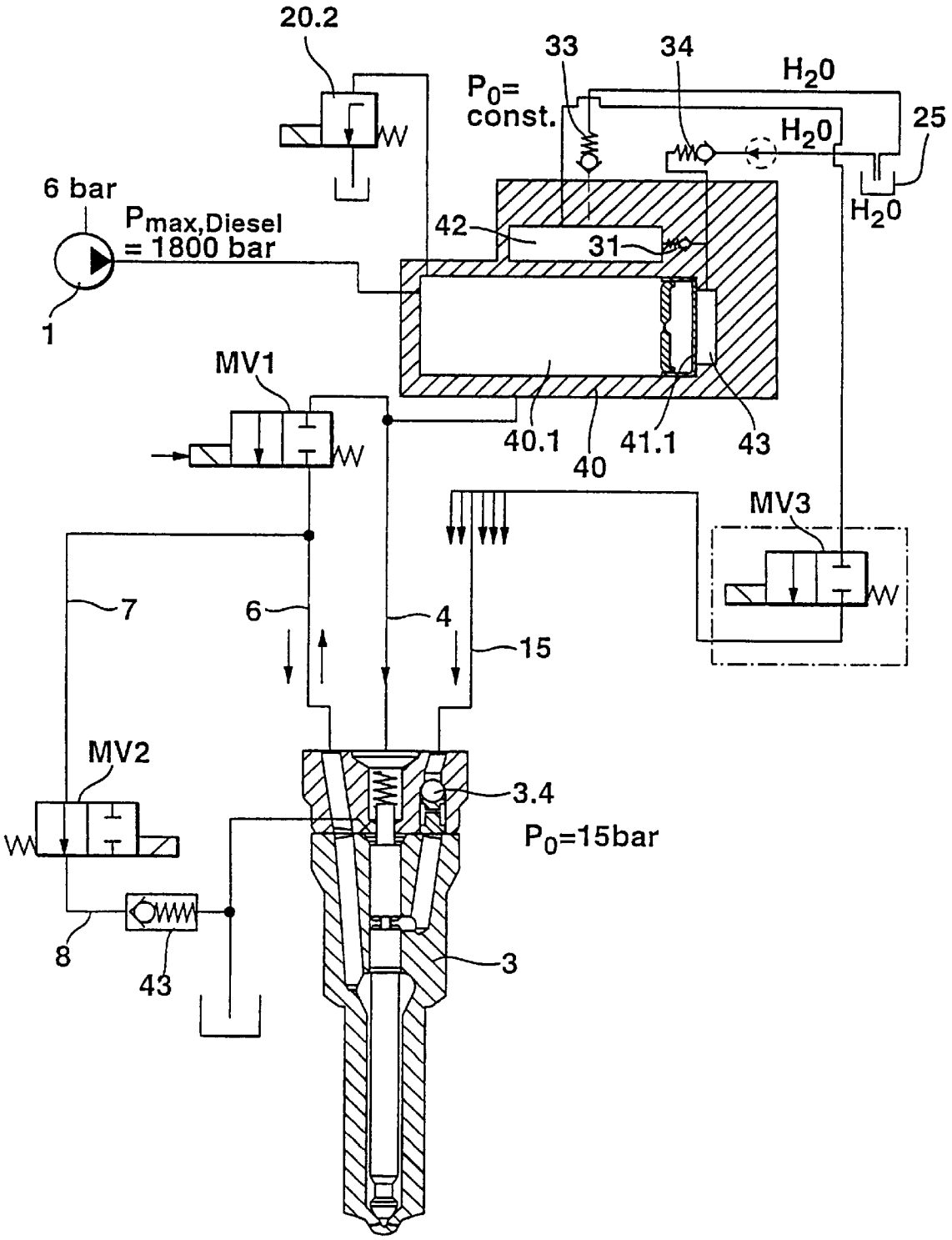
FIG. 4 shows a fourth exemplary embodiment analogous to FIG. 3, which likewise has an additional common rail pressure reservoir for the additive fluid, wherein, however, the membrane produces the delivery of additive fluid directly, without a lever mechanism and without a pump piston, but merely by means of pressure impacts.

Finally, FIG. 4 shows a modification of the embodiment according to FIG. 3, in which a lever mechanism 22 and an adjusting mimic have been eliminated. The delivery and metering here are executed directly by the membrane 41.1, which is connected to the high-pressure chamber 40.1 of the common rail pressure reservoir 40 for fuel and which, when there is a corresponding overpressure in the high-pressure chamber 40.1, sends a pressure impact to a chamber 43 charged with additive fluid, which impact is sent further into the additional common rail pressure reservoir 42 by way of the check valve 31. The other functions are completely analogous to those of the exemplary embodiment according to FIG. 3.

The foregoing relates to preferred exemplary embodiments of the invention, it being understood that other variants and embodiments thereof are possible within the spirit and scope of the invention, the latter being defined by the appended claims.

We claim:

1. A fuel injection system for an internal combustion engine, comprising a high-pressure pump (1) for delivering fuel into a dual-fuel injector (3), a delivery device for delivering an additive fluid conveyed by way of a check valve (3.4), into an additive fluid line (15) that leads to the dual-fuel injector (3) and is connected to a pressure chamber (3.5) that encloses an injector needle (3.1) of the dual-fuel injector (3), a valve device for storing the additive fluid quantity in the dual-fuel injector (3), wherein an opening and closing of the injector needle (3.1) occurs by means of the pressure of a common rail pressure reservoir (2; 20; 30; 40) filled with high-pressure fuel, the valve device is disposed at least partially in an injection line (6), and when storing the additive fluid, interrupts the fuel supply to the injector (3) and connects the pressure chamber (3.5) to a low-pressure fuel side and otherwise interrupts a connection to a low-pressure fuel side and acts on the pressure chamber (3.5) with high-pressure fuel, a first 2/2-way valve (MV1) is provided in the injection line (6) between the common rail pressure reservoir (2; 20; 30; 40) and the pressure chamber (3.5) and a second 2/2-way valve (MV2) is provided, whose inlet, via a supply line (7), is connected to the injection line (6) at a point between the first 2/2-way valve (MV1) and the pressure chamber (3.5), and whose outlet is connected to the low-pressure fuel side via an outlet line (8).

2. The fuel injection system according to claim 1, in which a check valve (9) is provided in the outlet line (8) between the second 2/2-way valve (MV2) and the low-pressure fuel side.

3. The fuel injection system according to claim 1, in which on a blunt axial end of the injector needle (3.1) remote from an injector needle tip, in whose axial extension a piston (3.3) is affixed to the injector needle (3.1), preferably of one piece with it, which piston, with its axial end remote from the injector needle (3.1), protrudes into a chamber (3.6), which is sealed in a pressure tight manner in relation to the chamber (3.2) of the dual-fuel injector (3) that encompasses the blunt axial end of the injector needle (3.1), and is acted on by the high pressure prevailing in the common rail pressure reservoir (2; 20; 30; 40).

4. The fuel injection system according to claim 3, in which on a blunt axial end of the injector needle (3.1) remote from an injector needle tip, in whose axial extension a piston (3.3) is affixed to the injector needle (3.1), preferably of one piece with it, which piston, with its axial end remote from the injector needle (3.1), protrudes into a chamber (3.6), which is sealed in a pressure tight manner in relation to the chamber (3.2) of the dual-fuel injector (3) that encompasses the blunt axial end of the injector needle (3.1), and is acted on by the high pressure prevailing in the common rail pressure reservoir (2; 20; 30; 40).

5. The fuel injection system according to claim 3, in which the chamber (3.2) that contains the blunt axial end of the injector needle (3.1) is connected to the low-pressure fuel side by way of a ventilation line (5).

6. The fuel injection system according to claim 1, in which a membrane (21.1; 41.1) is connected to a pressure-carrying end of the common rail pressure reservoir (20; 30; 40); one side of this membrane is acted on by the high pressure prevailing in the common rail pressure reservoir (20; 30; 40) and its other side, when there are pressure fluctuations in the common rail pressure reservoir (20; 30; 40), can directly or indirectly deliver additive fluid from a reservoir (25) and finally into the additive fluid line (15) leading to the dual-fuel injector (3).

7. The fuel injection system according to claim 6, in which the other side of the membrane (21.1) that is remote from the high pressure in the common rail pressure reservoir (20; 30) is connected to a lever mechanism (22), which can drive a pump piston (23.1) when there is a corresponding movement of the membrane (21.1), which delivers additive fluid from the reservoir (25).

8. The fuel injection system according to claim 7, in which in a line (29) from the reservoir (25) to the pump piston (23.1), from which the additive fluid line (15) leading to the dual-fuel injector (3) branches, a pre-feed pump (26)

is provided for delivering additive fluid over greater distances and/or counter to a geodetic gradient.

9. The fuel injection system according to claim 8, in which a check valve (27) is disposed in the line (29) between the pre-feed pump (26) and the branch point of the additive fluid line (15) leading to the dual-fuel injector (3).

10. The fuel injection system according to claim 9, in which an overpressure line leading to the reservoir (25), which line leads from the additive fluid line (15) leading to the dual-fuel injector (3), is provided with an overpressure check valve (28) which opens when a corresponding threshold pressure in the additive fluid line (15) is exceeded and connects the additive fluid line (15) directly to the reservoir (25).

11. The fuel injection system according to claim 7, in which an adjusting mechanism is provided for adjusting the lever mechanism (22) and therefore the stroke volume moved by the pump piston (23.1).

12. The fuel injection system according to claim 8, in which an adjusting mechanism is provided for adjusting the lever mechanism (22) and therefore the stroke volume moved by the pump piston (23.1).

13. The fuel injection system according to claim 9, in which an adjusting mechanism is provided for adjusting the lever mechanism (22) and therefore the stroke volume moved by the pump piston (23.1).

14. The fuel injection system according to claim 10, in which an adjusting mechanism is provided for adjusting the lever mechanism (22) and therefore the stroke volume moved by the pump piston (23.1).

15. The fuel injection system according to claim 11, in which the adjusting mechanism is driven by an electric motor (24.3).

16. The fuel injection system according to claim 15, in which the electric motor (24.3) drives a spindle (24.2) that is screwed into a longitudinally movable slider (24.1) upon which a lever of the lever mechanism (22) is rotatably supported.

17. The fuel injection system according to claim 6, in which the membrane (21.1; 41.1) is clamped in a pressure-tight fashion in the common rail pressure reservoir (20; 30; 40) by way of a mass wall (21.2), wherein the mass wall (21.2) has a diaphragm bore (21.3) through which fuel can travel into or out of a chamber (21.4) between the membrane (21.1; 41.1) and the mass wall (21.2), depending on the direction of the pressure difference.

18. A process for operating a fuel injection system according to claim 11, in which pressure fluctuations occurring in the common rail pressure reservoir (20; 30; 40) are measured and based on the measurements, control commands are sent to the adjusting mechanism, which correspond to the membrane identity and the current demand for additive fluid to be supplied.

19. A process for operating a fuel injection system according to claim 11, in which the current stroke of the pump piston (23.1) is measured and based on the current stroke, control commands are sent to the adjusting mechanism, which correspond to the membrane identity and the current demand for additive fluid to be supplied.

20. The fuel injection system according to claim 7, in which an additional common rail pressure reservoir (32) for containing the pressurized additive fluid is provided, which is connected by way of a 2/2-way valve (MV3) to the additive fluid line (15) leading to the dual-fuel injector (3) and is connected via a check valve (31) to the delivery side of the membrane-operated pump piston (23.1).

21. The fuel injection system according to claim 6, in which an additional common rail pressure reservoir (42) for containing pressurized additive fluid is provided, which is connected by way of a 2/2-way valve (MV3) to the additive fluid line (15) leading to the dual-fuel injector (3) and is connected via a check valve (31) to the delivery side of the membrane (41.1) that delivers the additive fluid.

22. The fuel injection system according to claim 20, in which the additional common rail pressure reservoir (32; 42) for additive fluid is preferably integrated into and of one piece with the common rail pressure reservoir (30; 40) for fuel.

23. The fuel injection system according to claim 20, in which the 2/2-way valve (MV3) in the additive fluid line (15) is structurally identical to the first 2/2-way valve (MV1) in the injection line (6).

24. The fuel injection system according to claim 20, in which the 2/2-way valve (MV3) in the additive fluid line (15) supplies a group of several dual-fuel injectors (3) in chronological sequence.

25. The fuel injection system according to claim 20, in which the additional common rail pressure reservoir (32; 42) for additive fluid is connected to the reservoir (25) for additive fluid by way of a pressure maintenance valve (33) and the second 2/2-way valve (MV2) is connected to the low-pressure fuel side by way of another pressure maintenance valve (43).

* * * * *